United States Patent [19]

Walker

[11] Patent Number: 4,831,760

[45] Date of Patent: May 23, 1989

[54] SIGN ASSEMBLY

[76] Inventor: Joseph L. Walker, 94 Saratoga Rd., Stratford, N.J. 08084

[21] Appl. No.: 822,341

[22] Filed: Jan. 24, 1986

[51] Int. Cl.[4] ..... G09F 7/00

[52] U.S. Cl. ..... 40/620; 40/606

[58] Field of Search ..... 40/10 C, 620, 606, 542, 40/596, 582, 618, 623, 210, 209, 200; 119/121; 52/153, 154; 248/530, 532, 508, 156; 135/118

[56] References Cited

U.S. PATENT DOCUMENTS

| | | | |
|---|---|---|---|
| 871,564 | 11/1907 | Brown | 119/121 |
| 1,902,875 | 3/1933 | Mason | 52/153 |
| 1,985,227 | 12/1934 | Bland | 40/620 |
| 2,010,385 | 8/1935 | Weaver | 40/209 |
| 2,073,716 | 3/1937 | Sunderhauf | 40/582 |
| 2,125,437 | 8/1938 | Geary | 40/620 |
| 2,236,068 | 3/1941 | Rapp | 40/620 |
| 2,271,456 | 1/1942 | Hendricks | 40/618 |
| 2,510,331 | 6/1950 | Crosby | 40/618 |
| 2,580,688 | 1/1952 | McNulty et al. | 40/620 |
| 2,588,183 | 3/1952 | Vigon | 40/542 |
| 2,658,295 | 11/1953 | Young | |
| 3,074,193 | 1/1963 | Munson | 40/618 |
| 3,296,724 | 1/1967 | Deuchar | 40/618 |
| 3,978,599 | 9/1976 | Berger | 40/542 |
| 4,185,424 | 1/1980 | Streit | 119/121 |
| 4,196,533 | 4/1980 | Kamphausen | 40/106 |

FOREIGN PATENT DOCUMENTS

| | | | |
|---|---|---|---|
| 534983 | 2/1955 | Belgium | 40/620 |
| 269539 | 5/1928 | Italy | 40/620 |
| 395388 | 7/1933 | United Kingdom | 40/618 |

*Primary Examiner*—Robert P. Swiatek
*Assistant Examiner*—Cary E. Stone
*Attorney, Agent, or Firm*—Caesar, Rivise, Bernstein, Cohen & Pokotilow, Ltd.

[57] ABSTRACT

A sign assembly is provided for visual displays. The sign assembly includes display indicia and a body member of unitary construction. The body member includes at least one display area and a staking assembly integrally formed with the display area. The staking assembly is to be inserted into the ground to hold the display area above the ground. Indicia are affixed to the display area to produce the display. The sign assembly is preferably molded of high impact resistant plastic material and the indicia are preferably reflective plastic material characters, such as numerals or letters, which are screwed onto the display area. In an alternate embodiment, the stake assembly is eliminated and the body member is affixed to a surface, rather than inserted into the ground.

21 Claims, 2 Drawing Sheets

FIG. 1
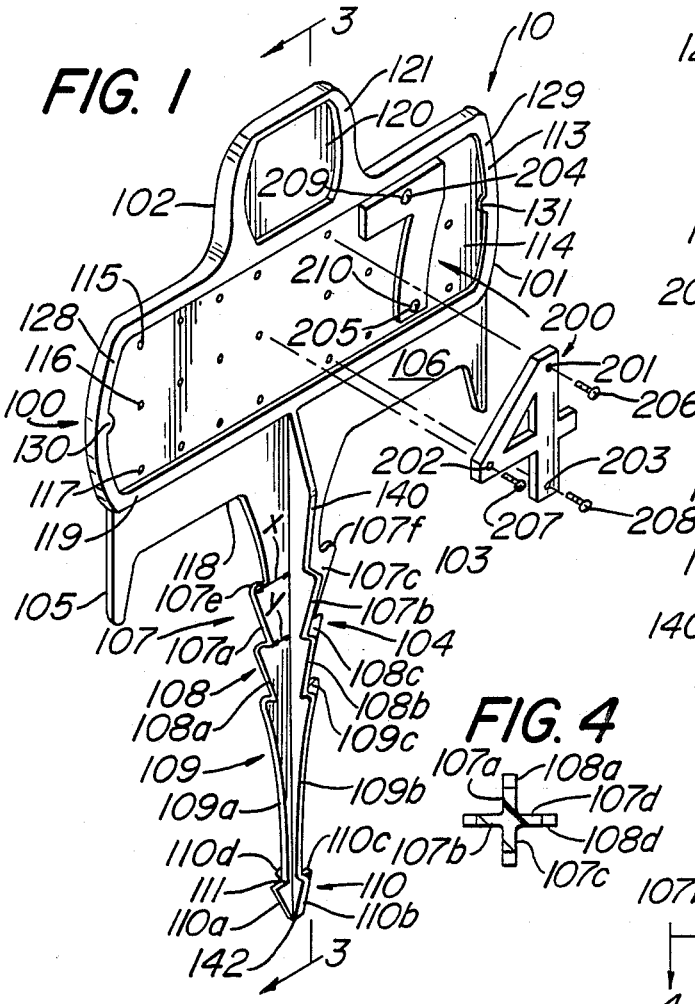
FIG. 4
FIG. 2
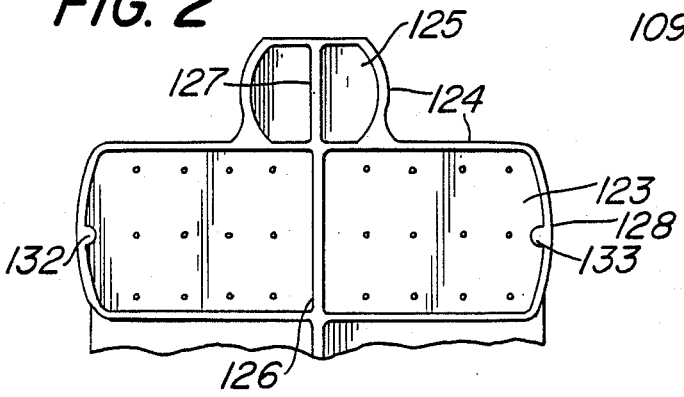
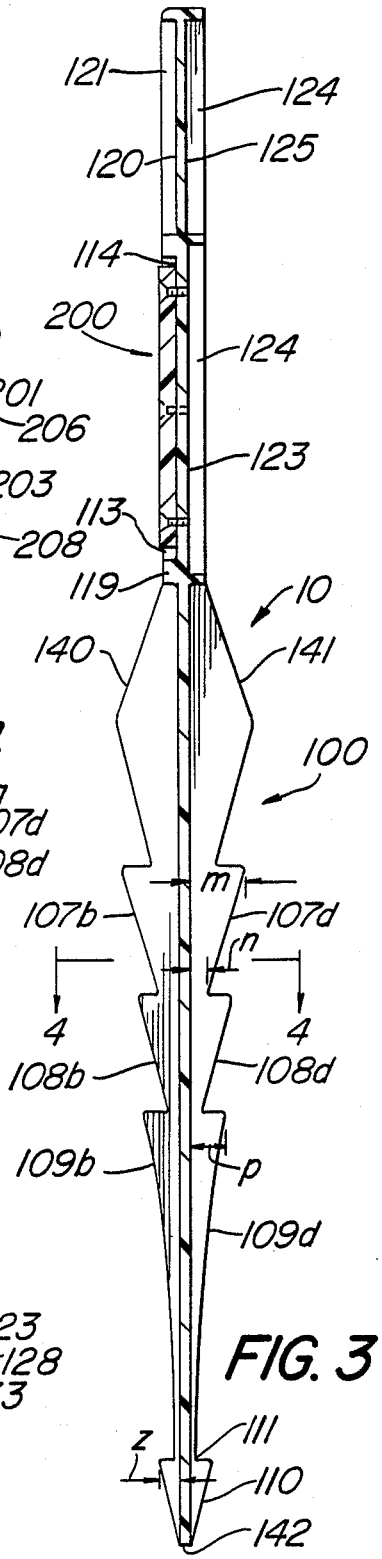
FIG. 3

SIGN ASSEMBLY

BACKGROUND OF THE INVENTION

The present invention relates to markers or signs, and in particular, the invention relates to a sign of unitary construction. In one embodiment the body of the sign is designed to be mounted onto a flat surface, and in another embodiment the body of the sign is designed to be inserted into the ground. Furthermore, the sign is intended to have mounted thereon reflective display indicia, such as numerals, letters or other characters or designs.

Markers or signs that are designed to be affixed to building walls or even inserted into the ground are known in the art. However, a need exists for a sign or marker of visual display which can be easily, quickly and economically manufactured as a single, unitary construction. In addition, the sign should be sturdy, impact resistant and should stand up well against the elements, including heat, cold and chemicals (especially if the sign is to be inserted into the ground, such as on a lawn or golf course.)

Furthermore, there is a need for a sign or marker which has characters that can be easily and reliably affixed thereto. It is also necessary that the characters have a high degree of visibility during daylight and at night. The characters should also be impervious to the elements and to chemicals.

Also, there is a need for signs or markers which, in addition to providing information such as street addresses or specific numbers, also provide a space for promotional advertising or additional information.

OBJECT OF THE INVENTION

With the above background in mind, it is a primary object of the present invention to provide a marker or sign assembly which includes a body member formed as a one-piece unit and which is adapted to have various indicia, such as numerals and/or letters, attached to the body member.

It is a further object of the invention to provide a marker or sign assembly of high impact resistant plastic material which can be formed by an injection molding process and which is impervious to the elements, such as heat, cold and sunlight and to chemicals, such as lawn and garden chemicals and insecticides.

A still further object of the invention is to provide a marker or sign assembly having highly reflective indicia characters of plastic material, and in an alternative embodiment to provide indicia characters of plastic material which have been impregnated with phosphorescent material.

Yet a further object of the invention is to provide a one-piece marker or sign assembly which can be easily affixed to a wall or another flat surface.

Another object of the invention is to provide a marker or sign assembly which can be inserted into the ground and held securely in the ground.

One further object of the present invention is to provide a marker or sign assembly having more than one display area so that information in addition to that provided by the primary indicia, i.e., the characters affixed thereto can also be displayed.

SUMMARY OF THE INVENTION

In furtherance of these objectives, a high impact resistant, injection molded sign assembly is provided.

The sign assembly includes a body member which contains at least one display area and a staking assembly integrally formed with the display area and display indicia affixed to the display area. The staking assembly allows the sign assembly to be inserted into the ground and held there firmly. The body member contains, preferably, two display areas. one above the other, for holding the indicia to be displayed by the sign assembly. The indicia maybe separate characters such as numerals or letters. The separate characters are, preferably, of reflective plastic material and are affixed to at least one of the display areas by self-tapping screws. The other display area may also have indicia affixed thereto by screws, but additional methods of applying the indicia to either display area including painting, silkscreening or by means of adhesive-backed material.

An alternative embodiment of the invention eliminates the staking assembly, and the display area forming the body member includes holes so that the body member can be screwed or otherwise mounted onto a wall or other flat surface.

DESCRIPTION OF THE DRAWINGS

Other objects and many of the attendant advantages of the instant invention will be readily appreciated as the same becomes understood with reference to the following detailed description when considered in connection with the accompanying drawings, wherein:

FIG. 1 is a perspective view of the sign assembly of the present invention showing the manner of affixing a numeral to the body member of the sign assembly.

FIG. 2 is a partial rear plan of the backside of the top of the sign assembly of the present invention.

FIG. 3 is a section view of the sign assembly taken along line 3—3 of FIG. 1.

FIG. 4 is a section view of the sign assembly taken along line 4—4 in FIG. 3.

DETAILED DESCRIPTION OF THE PREFERRED EMBODIMENT

Figure 5:
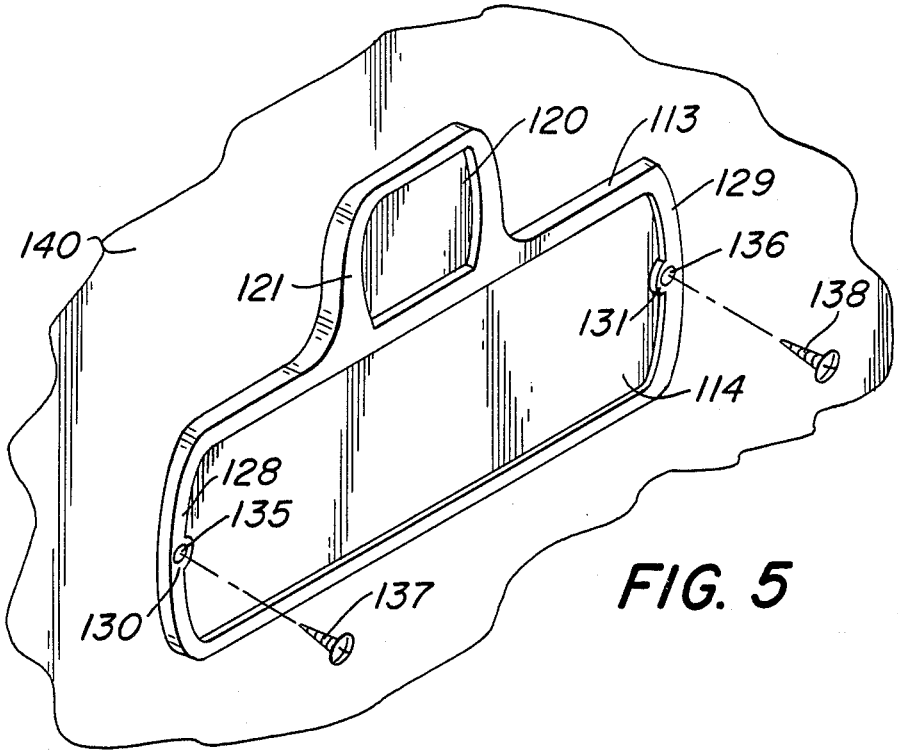
FIG. 5 is a perspective view of an alternate embodiment of the sign assembly of the present invention.

Referring now in greater detail to the various figures of the drawings wherein like reference characters refer to like parts, a marker or sign assembly of the present invention is generally shown at 10 in FIGS. 1 and 3. The sign assembly 10 comprises, generally, a body member 100 and indicia 200 (such as numerals or letters) which are affixed to the body member 100.

The body member 100 as shown in FIG. 1 is of unitary construction with a first display area 101 and a second display area 102 above the first display area 101. Beneath the first display area 101 and integrally formed therewith is a staking assembly generally referred to as 103. The staking assembly 103 includes an elongated center spike 104 and two side spikes 105, 106 spaced on either side of the center spike 104. The center spike 104 and side spikes 105, 106 are integrally formed with and extend downward from a bracket 118 formed along the bottom edge of 119 of the first display area 101.

The center spike 104, as shown in FIGS. 1 and 3, has three aligned barbs 107, 108, 109 along its length and a fourth pointed barb 110 at the very tip 111 thereof. Each barb 107, 108, 109, 110 has four prongs 107*a–d*, 108*a–d*, 109*a–d* and 110*a–d* respectively. As shown in FIG. 4, the prongs *a–d* of each barb form an X-shape in cross-section. THe opposing prongs, a,c and b,d, of each barb 107, 108, 109 are the same size and configuration and are wider at the top than the bottom, tapering inward in the direction of the central axis of the center spike 104. The aligned prongs 107*a,c,* 108*a,c* and 109*a,c* and 107*b,d,* 108*b,d* and 109*b,d* decrease in width along the length of the center spike 104, i.e., the prongs of the different bars become smaller in width from the top-most barb 107 to the middle barb 108, to the next barb 109. The four prongs 110*a*–110*d* of the bottom barb 110 are identical in size and configuration, and the maximum width ("z" in FIG. 3) of the prongs 110*a–d* is less than the maximum width of the next larger prongs 109*b,d* ("p" in FIG. 3).

The increasing size of the prongs *a,c* and *b,d* for each barb 109, 108, 107 upward from the smallest barb 110 along the center spike 104 makes it easier to force the spike 104 into the ground by gradually increasing the width being inserted. This construction also makes it more difficult to pull the center spike out of the ground since the greatest width barb 107 is at the top.

The distance along the center spike 104 to the top edges 107*e–f* of the top-most prongs 107*a–d* is greater than the length of the side spikes 105, 106, to insure that the uppermost prongs 107*a–d* will be completely in the ground before the side spikes 105, 106 reach the ground level. Thus, before the side spikes 105, 106 are inserted into the ground to stabilize any twisting movement of the body member 100 all of the barbs 107-110 are already in the ground.

Also provided to stabilize the body member 100 in the ground are two projections 140, 141 on the center spike 104 and the bracket 118 which are above and aligned with the prongs 107b, 107d of the barb 107. These two projections 140,141 further aid in suppressing any twisting movement of the body member 100 which might cause the staking assembly 103 to loosen in the ground and allow the spikes 104, 105, 106 to work their way out of the ground.

As further shown in FIGS. 1 and 3, the first display area 101 has a substantially rectangular shape with a raised edge 113 surrounding a first display surface 114. Three parallal rows 115, 116, 117 of the holes are provided in the first display surface 114 for affixing the display indicia 200 to the first display surface 114. These rows 115, 116, 117 of holes are either molded or drilled into the display surface 114.

Above the first display area 101 is the second display area 102 with a second display surface 120. The second display area 102 also has a raised edge 121 which surrounds the display surface 120. The raised edge 121 of the second display area 102 is level with and continuously formed with the raised edge 113 around the first display area 101.

The partial rear view of the body member 100 shown in FIG. 2 and the sectional view of FIG. 3, show a raised edge 124 which completely surrounds the backside 123 of the first display surface 114 and the backside 125 of the second display surface 121. This second raised edge 124 is continuously formed with the first raised edge 113 around the edges of the first and second display surfaces 114, 121, respectively, so that viewed from the side there is one continuous edge (FIG. 1) surrounding the display areas 101,102. Also visable in FIG. 2 are two vertical supports 126, 127 the same thickness as and continuously formed with the raised edge 124. The first vertical support 126 extends across and is formed with the backside 123 of first display area and the second vertical support 127 extends across and is formed with the backside 125 of the second display area 121. Both vertical supports 126, 127 provided structural reinforcement to the body member 100 of the sign assembly 10.

On the two narrower sides 128, 129 of raised edge 113 are two raised semi-circular areas 130, 131. These two areas 130, 131 are the same thickness as and are integrally formed with the raised edge 113 around the front of the first display surface 114. Two additional raised semi-circular areas 132, 133 are formed on the backside 123 of the first display surface (FIG. 2) directly behind the two raised areas 130, 131 on the front surface. The two raised areas 132, 133 on the backside 123 of the first display area are the same thickness as the second raised edge 124 and are integrally formed therewith. These four back-to-back semi-circular areas on the front and back of the first display surface 114 can have holes 135, 136 (FIG. 5) molded or drilled therethrough so that the sign assembly may be mounted onto a wall or similar surface 140 by passing screws 137, 138 through the holes in the semi-circular areas 130, 131. This aspect of the sign construction will be more fully discussed later.

The indicia 200 which can be affixed to the first display surface 114 are represented by the numeral characters "4" and "7" in FIG. 1. It is understood, however, that the invention is intended for use with all types of indicia, including numeric and alphameric characters, plaques and adhesive-backed material. In the embodiment shown in FIGS. 1 and 3, the characters "4" and "7" have holes 201–205 therethrough. These holes may be drilled or molded into the characters and are designed to receive self-tapping screws 206–210 therethrough. These screws 206–210 pass through the holes 201–205 in the characters and are held in holes in the rows of holes 115–117. The screws 206–210 are preferably nylon, stainless steel or any other weather and corrosion resistant material. All numeral characters except for the numeral "4", can be affixed to the first display surface 114 using only two screws such as the two screws 209, 210 passing through the numeral "7" in FIG. 1 and held in the first and third rows of holes 115, 117, respectively. Only the numeral "4", because of its width, requires a third hole 202 through the horizontal portion thereof. The third hole 202 permits a third screw 207 to pass therethrough into one of the holes in the second or middle row 116 of holes.

While the first display surface 114 has holes for attaching the indicia 200, such as numerals or letters, thereto, the second and smaller display surface 121, preferably, is smooth and free from any holes. The smooth second display surface 121 can be used to provide a place for other indicia such as those provided on adhesive-backed material which can simply be adhered to the surface. If necessary, of course, holes could be provided through the second display surface as well in order to attach other indicia such as letters, numerals, or plaques thereto.

The body member 100 of the sign assembly 10 is preferably made from high impact resistant and weather and temperature resistant acrylic plastic material which can be used in injection molding of the body member 100. It is further preferred that the plastic material be resistant to most ordinarly chemicals found in the soil and outside ground conditions, such as lawn treatment chemicals, insecticides, and chemical ice melt compositions which might come into contact with the sign assembly 10. One such acrylic plastic material which can be used in acrylonitrite-butadlone-styrene (ABS).

In a preferred embodiment, the first display area 101 is approximately 41/2 inches high and 91/2 inches wide. The center spike 104 is 10 inches long from the bottom of the bottom edge 119 of the first display area 101 to the tip 142 of the bottom barb 110. Each of the side spikes 105, 106 is approximately 2 inches long measured from the bottom edge 119 of the first display area 101. The widest prongs 107*a*, 107*c* are approximately $\frac{7}{8}$ of an inch wide at the tips 107*e*, 107*f* thereof (the distance "x" in FIG. 1) tapering to 7/16 of an inch at the base (the distance "y" in FIG. 1). The other wide prongs 107*b*, 107*d* are $\frac{1}{2}$ an inch wide at the widest part (the distance "m" in FIG. 3) and taper to $\frac{1}{8}$ of an inch at the narrowest part (the distant "n" In FIG. 3.) The prongs 110*a–d* of the smallest barb are only $\frac{1}{4}$ of an inch wide at their widest point (the distance "z" in FIG. 3.) The second display area 102 measures approximately 2 inches by 2 inches and is centered above the the first display area 101. The combined thickness of the raised edges 113, 120 and 124 is approximately $\frac{3}{8}$ of an inch.

The sign assembly 10 can be constructed, preferably by injection molding, in either of two ways. When the sign assembly 10 is to be inserted into the ground, the body member 100, as shown in FIG. 1, includes the staking assembly 103, i.e., the center spike 104, the side spikes 105, 106, and bracket 118 are provided. The center spike 104 when pushed into the ground is held securely against any vertical or lateral motion by the barbs 107–110. Furthermore, twisting of the display area portions 101, 102 of the body member is prevented by inserting the side spikes 105, 106 into the ground as well along with the projections 140, 141 on the center spike 104 and bracket 118.

If the sign assembly 10 is not intended to be inserted into the ground, the entire staking assembly 103, including the bracket 118 beneath the edge 119 of the first display area 101 can be eliminated. By eliminating these features, the two display areas 101, 102 remain with the raised edges 113 and 120 around the first and second display areas (FIG. 5). When the staking assembly 103 is eliminated, other means are provided to mount the body member to a wall 140 or other surface. One way of mounting the body member is to provide holes 135, 136 through the raised semi-circular areas 130–133 so that screws 137, 138 can be inserted through the holes to attach the body member to a wall or similar flat surface.

The indicia 200 are preferably characters, such as numerals, made of molded, transparent methyl-methacrylate. The top and sides of the characters are smooth and polished. The back of the characters is preferably light reflective. This can be achieved by providing the backside of the characters with a light-reflective material, such as a reflective foil, or, more preferably, the backs of the characters can be hollowed out and molded with a prismatic, rough-cut diamond surface, with a $\frac{1}{8}$ to 3/16 of an inch smooth border around the perimeter of the underside of the character.

In addition to being light-reflective, the characters can be made to be luminescent by adding a phospherous chemical pigment to the plastic material when the characters are being molded. This phospherous material gives the characters a light retention capability and allows the characters to continue to emit light or glow for a limited period of time after being activated by a light source.

The characters are affixed to the first display surface 114 by the self-tapping screws 206–210 passing through holes in the characters and into holes in the rows 115–117 in the display surface 114. If, as an alternative, no holes are provided in the characters or in the display area, the characters can be adhered to the display area by an adhesive. With the character described above which has the smooth border around the underside, the adhesive can be applied to this border, thereby leaving the reflectively cut back of the character free from any adhesive.

In addition to providing characters which are reflective, it is also possible to provide a reflective coating on the entire first display surface 114. This may be accomplished by such means as painting the surface with a relfective paint or by adhering a reflective tape or other reflective material to the surface 114 before the indicia are affixed. The addition of the reflective material to the first display area further enhances the display of the characters in the first display area 101.

Without further elaboration, the foregoing will so fully illustrate my invention that others may, by applying current or future knowledge, readily adopt the same for use under various conditions of service.

What is claimed as the invention is:

1. A sign assemby for providing a visual display, said assembly comprising:

a body member of unitary construction, said body member having at least one display area and staking means integrally formed with and extending from said display area for staking said body member in the ground, said staking means being comprised of a bracket along the bottom of said display area, a side spike extending downward at each end of said brakcet, and a center spike extending downward from the center of said bracket; and indicia on said display area to provide said visual display.

2. A sign assembly as claimed in claim 1, wherein:

said body member has a first display area and a second dispaly area above said first display area, said display areas being integrally connected to each other.

3. A sign assembly as claimed in claim 2, wherein each of said display areas has a display surface and a raised edge around said display surface.

4. A sign assembly as claimed in claim 3, wherein said display surface of said first display area has a plurality of holes therein for attaching said indicia to said first display area.

5. A sign assemby as claimed in claim 3, wherein said display surface of said first display area is reflective outwardly away from said display area.

6. A sign assembly as claimed in claim 2, wherein said indicia comprises at least one reflective character.

7. A sign assembly as claimed in claim 6, wherein;

said first display area has a plurality of holes therein;

said reflective character has a plurality of holes therein; and said indicia further comprises screw means adapted to fit through said holes in said character and said holes in said first display area for affixing said character to said first display area.

8. A sign assemby as claimed in claim 6, wherein said character is comprised of translucent material and a reflective material on the back of said translucent material which reflects light outwardly through said translucent material.

9. A sign assembly as claimed in claim 6, wherein said character is comprised of translucent material, and said back surface of said character is formed to provide a prismatic reflective surface which reflects light outwardly through said translucent material.

10. A sign assembly as claimed in claim 2, further comprising indicia on said second display area.

11. A sign assembly as claimed in claim 10, wherein said indicia on said second display area is printed on said second display area.

12. A sign assembly as claimed in claim 10, wherein said indicia on said second display area comprises an adhesive-backed sticker affixed to said second display area.

13. A sign assembly as claimed in claim 1, wherein:
said center spike is longer than said side spikes; and
said center spike has a plurality of barb means along the length thereof for holding said center spike in the ground.

14. A sign assembly as claimed in claim 13, wherein each of said barb means comprises four prongs projecting outwardly from said center spike.

15. A sign assembly as claimed in claim 13, wherein said center spike has four barb means graduated in width along the length thereof.

16. A sign assembly as claimed in claim 15, wherein said graduated barb means decrease in width downward along said center spike.

17. A sign assembly as claimed in claim 1, wherein said body member is comprised of high impact resistant acrylic plastic material.

18. A sign assembly as claimed in claim 17, wherein said plastic material is comprised of acrylonitrile-butadlone-styrene.

19. A sign assembly as claimed in claim 1, wherein said indicia is comprised of at least one character of a plastic material.

20. A sign assembly as claimed in claim 19, wherein said plastic material is comprised of methyl-methacrylate.

21. A sign assembly as claimed in claim 19, wherein said character is further comprised of phospherous chemical pigment in said plastic material, whereby said character has light retention capability.

* * * * *